United States Patent [19]

Boschian

[11] Patent Number: 4,761,007

[45] Date of Patent: Aug. 2, 1988

[54] DEVICE FOR REDUCING VIBRATIONS OF A TENNIS RACQUET

[76] Inventor: Louis Boschian, Le Soleil Levant - Bâtiment B 8 Avenue des Rives, 06270 Villeneuve Loubet, France

[21] Appl. No.: 866,129

[22] Filed: May 21, 1986

[30] Foreign Application Priority Data

May 22, 1985 [FR] France ..... 85 07830
Jul. 23, 1985 [FR] France ..... 85 11356

[51] Int. Cl.[4] ..... A63B 49/00
[52] U.S. Cl. ..... 273/73 D
[58] Field of Search ..... 273/73 R, 73 C, 73 D, 273/67 R, 29 A; 84/234; 174/42; 75/574; 49/9; 73/430; 173/139

[56] References Cited

U.S. PATENT DOCUMENTS 4,609,194 9/1986 Krent et al. ..... 273/73 D

FOREIGN PATENT DOCUMENTS 3123690 3/1983 Fed. Rep. of Germany .... 273/73 R
1398833 4/1965 France ..... 273/73 D

*Primary Examiner*—Richard C. Pinkham
*Assistant Examiner*—Matthew L. Schneider
*Attorney, Agent, or Firm*—Frishauf, Holtz, Goodman & Woodward

[57] ABSTRACT

A device is adapted to be used in conjunction with a racquet for tennis or for a similar sport, and wherein the racquet is strung with a plurality of strings under a certain tension. The strings extend in a mesh along longitudinal and transverse directions so as define a plurality of rectangles. Each rectangle has sides of predetermined dimensions, and is bounded by a pair of adjoining strings extending along the longitudinal direction. Another pair of adjoining strings extends along the transverse direction. At least one plate of elastic material is adapted for being emplaced in one rectangle so as to engage at least two adjoining strings, and is of such dimensions so as to, upon emplacement, deform the so engaged strings so that they are spread apart by a distance exceeding the predetermined dimension by about 2 to 3 millimeters. Thus the so engaged strings are subjected to a supplemental tension exceeding the certain tension. In a preferred embodiment a weight is attached to the plate.

14 Claims, 3 Drawing Sheets

DEVICE FOR REDUCING VIBRATIONS OF A TENNIS RACQUET

The present invention relates to a new device intended to attenuate the vibrations of a tennis racquet at the moment the ball is struck. It is well known that each tennis stroke of the racquet causes high frequency vibrations of the racquet, and that detrimental effects, particularly to the hand and arm of the player are attributed to these vibrations, particularly the affliction known as "tennis elbow".

Numerous attempts have already been made in an endeavor to attenuate these vibrations, either by the employment of new materials for construction of the frame or for the strings, be it by incorporation of attenuating devices between the strings and the frame, or between the head of the racquet and the grip. In this respect in the French Pat. No. 78/05748 it has been proposed to couple at least two parallel longitudinal strings with an element molded or pasted above these two strings to the exterior of the transverse strings in a manner so that they approach one another.

SUMMARY OF THE INVENTION

Applicant has noted that a much more effective attenuation effect can be obtained by more convenient means. This means consists of a removable device, which, once emplaced exerts simultaneously a pressure or spreading-apart effect onto four continguous strings, namely two transverse strings and two longitudinal strings defining a square, in which this device is emplaced.

Subjecting the four sides of the square simultaneously to tension results in an equidirectional attenuation effect, namely free of any preferential direction, which appears to be the explanation of the efficiency of this device in attenuating the vibrations of the racquet.

The attenuating device, according to the invention is implemented in the form of a disk of elastic material, the thickness of which is of the order of about 10 millimeters, and which is formed on its periphery with a groove in which the four strings concerned are nestled, and wherein the diameter of the disk at the base of the groove exceeds by about 2 mm the spacing between two parallel strings so that, once it is emplaced in a square between two parallel strings of each string pair, the device determines the spacing of the parallel strings of each respective string pair, and consequently a supplemental tension distributed equidirectionally onto the four sides of the square.

BRIEF DESCRIPTION OF THE DRAWINGS

According to a particularly efficient variant of the device according to the present invention, it is possible to supplement this device, which can be considered "passive", by an active element, namely one capable to be set into oscillatory movement itself, which, when added to that of the racquet, results in the cancellation of the oscillatory movement.

According to such a variant, the "active" element is a weight centered with respect to the device, and connected thereto by a flexible element which transmits to it these vibrations in their entirety.

Figure 2:
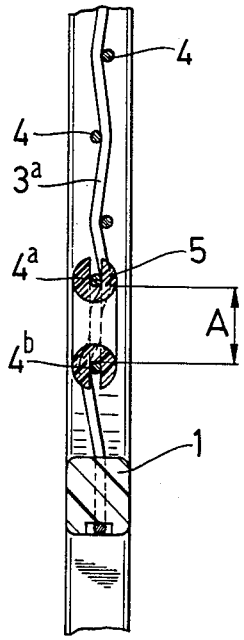

According to a first embodiment of this variant, this weight is situated at the center of the device and connected thereto by a flexible membrane so as to be bound up therewith by at least one part of its periphery.

In that case the weight may, for example, be a steel ball trapped between two slender sheets of elastic material taking the role of that membrane. The weight could equally be formed from molding the membrane and the device.

According to a second embodiment, the weight is formed by two plates, each being situated in a plane above the strings and joined by posts of elastic material taking the role of the spreading-apart device of the four aforesaid strings.

The device will now be described in greater detail with respect to its various embodiments.

Figure 1:
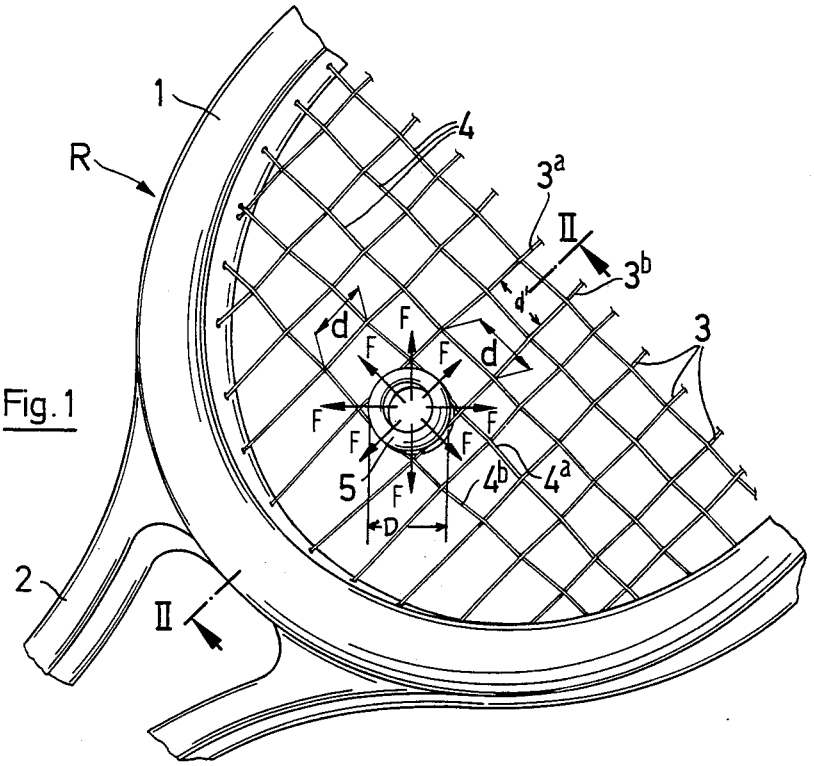
Figure 3:
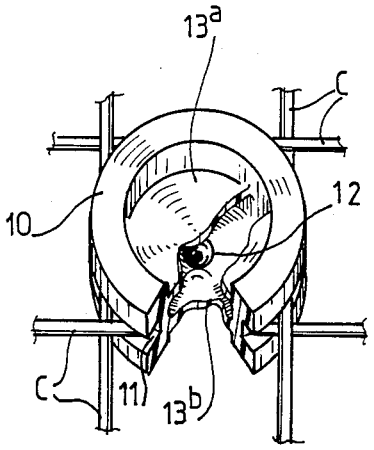
Figure 4:
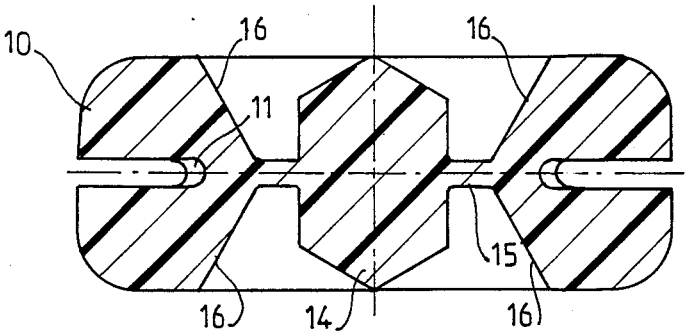
Figure 5:
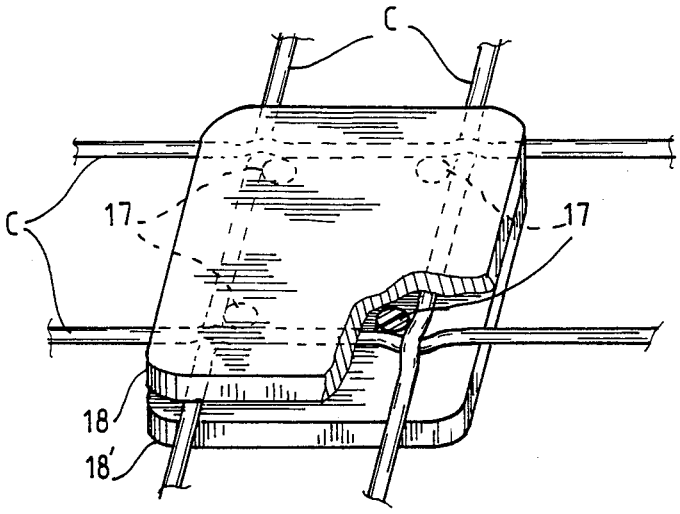
Figure 6:
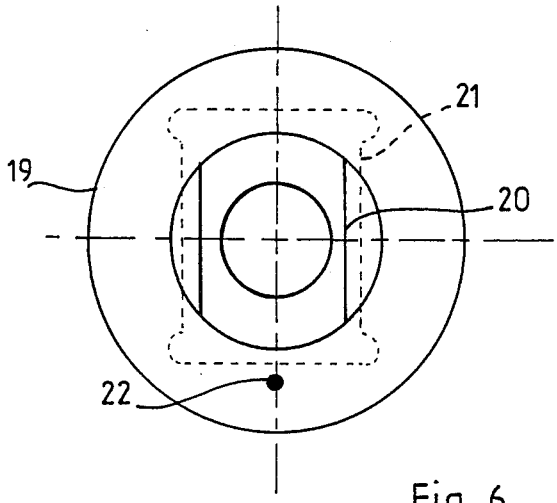

In the drawing:

FIG. 1 is a schematic illustration of the first embodiment of the device emplaced on a racquet, according to the invention, FIG. 2 is a section along line II—II of FIG. 1;

FIG. 3 is a perspective view, in part-section, of a first embodiment of the second variant of the device, according to the invention;

FIG. 4 is a section along line IV—IV of FIG. 3;

FIG. 5 illustrates a perspective view, in part-section, of a second embodiment of the second variant;

FIG. 6 is a plan view of an alternative embodiment of the device of FIG. 5.

DESCRIPTION OF THE PREFERRED EMBODIMENTS

Referring first of all to FIGS. 1 and 2, it will be seen that the racquet R consists, in a conventional manner of a frame 1, of a grip 2, of longitudinal strings 3, and transverse strings 4. The device, according to the invention, consists of a disk 5 inserted into the frame bounded by strings 3*a*, 3*b*, 4*a* and 4*b*. As will be seen from FIG. 2, it is formed on its periphery with a groove in which there are emplaced the aforesaid strings of the aforesaid square, which ensures that the emplacement of the device 5 is maintained.

According to the invention, the diameter D of the groove exceeds by about 2–3 mm the distance d between the corresponding strings 4*a*–4*b*; if the disc is exactly circular, the diameter D exceeds the distance d′ between the strings 3*a*–3*b* everywhere. If the device 5 is slightly oblong, as shown in FIG. 1, taking into consideration the string geometry, its longitudinal diameter D′ will exceed the distance d′.

The device 5, once emplaced, consequently stretches the strings of each respective string pair 3*a*–3*b* and 4*a*–4*b* apart by a distance of about 2–3 mm. These strings are therefore subjected to an equidirectional stress shown by the arrow F. Experience shows that this action consequently attenuates almost totally the vibrations which normally arise in a racquet on impact with a ball.

Apart from this effect, whose efficiency is experimentally superior to all means tried hitherto, this device has the advantage of being removable, instead of being pasted or molded in place as devices of this type which have already been proposed, particularly those described in the aforenoted French patent. It can therefore be emplaced in an area of the strings where it exerts an optimal effect.

As already indicated, the device can be circular or slightly oblong. It can also consist of a full disk, or an annulus, as shown. It is also possible to give it a different shape (square etc. . . ). It can be implemented by an elastic material whose flexibility permits its emplacement without damaging the strings, while preserving sufficient rigidity to assure spacing the string apart based on the effect of the forces F.

Referring now to FIG. 3, it will be seen that in that embodiment, the device consists of a torus 10, also of elastic material, while in a groove 11 thereof there are emplaced the four strings C forming the mesh of the racquet, as shown in FIGS. 1 and 2, but additionally including, according to the invention, a steel ball 12 entrapped between two slender membranes 13*a*–13*b* also of elastic material, and bound to the torus 10 in its median plane.

The embodiment shown in section in FIG. 4 differs from the preceding embodiment that instead of a steel ball entrapped between two membranes, there is provided a weight 14 resulting in the same effect, and which is obtained by being molded from one piece together with the sole membrane 15, which itself is integral with the torus 10. The junction regions 16 of the torus 10 with the membrane 15 are advantageously chamfered.

In these two embodiments, the weight 12 or 14, at the time when the racquet strikes the ball, is imparted with the vibrations of the racquet, transmitted thereby by the membrane or membranes, and experience shows that due to the presence of the vibrating element, foreign to the racquet, the co-action of these different phenomena results in a practically total cancellation of injurious vibrations of the racquet.

FIG. 5. shows another embodiment of such a weight constituted this time by two square plates 18 and 18' joined by four posts 17 of elastic material, which are placed at the interior of the square formed by the four strings C, by exerting thereon an outward push. The vibrations of the strings C are therefore transmitted to the plates 18–18', which play, in this instance, the same role as the preceding weights 12 and 14 disposed in the interior. It will be understood that the plates 18–18' can equally have a circular or other symmetrical form.

In all cases, introduction of the device into the strings is accomplished by elastic deformation, which involves the use of a relatively flexible elastic material.

Finally in FIG. 6 it is shown that the membrane or plates need only be integral with the torus in certain regions of their periphery, so as to take into account pressure differences between the strings. As the pressure exerted on the vertically extending strings exceeds those exerted on the horizontally extending strings, the membrane can be provided with a notch, so that engagement of the weight is accomplished preferentially with the vertically or longitudinally extending strings.

From FIG. 6 it can be seen that the plates 19, analogous to the plates 18 and 18' of FIG. 5, are chamfered at 20 along the same longitudinal sense as the grooves 21; this permits the use of a bench mark 22 so as to place the device correctly between the strings.

Finally, it is equally possible to attain a similar result by an assembly of weights distributed symmetrically on the torus 10, or on the plates, be it towards the interior, or the exterior. These weights may consist of very thin elastic strips obtained by molding it from the torus, and having a very slender joining region compared to the diameter of the device.

It will be understood that in the embodiment of FIG. 3, the metallic ball 12 may consist of a drop of mecury entrapped between the sheets 13*a*–13*b*. The advantage obtained from this embodiment is the benefit of an important weight which is located at a point.

Experience has shown that the new device has shown itself to be the most efficient of all devices which have been suggested and experimented with to-date.

Additionally the device can be used to decorate or personalize the racquet, by its color or shape, or serving to carry initials.

I claim:

1. The combination of a device used in conjunction with a racquet for tennis or for a similar sport, and wherein the racquet is strung with a plurality of elastic strings under a certain tension extending in a mesh along longitudinal and transverse directions so as define a plurality of rectangles, each rectangle having sides of a predetermined dimension, and being bounded by a pair of adjoining of said strings extending along said longitudinal direction, and another pair of adjoining of said strings extending along said transverse direction, comprising in said combination at least one plate of elastic material emplaceable in one of said rectangles so as to engage at least two of said adjoining strings, and being of such dimensions and having such an elasticity, compared to that of said strings, so as to, upon emplacement, deform the so engaged strings so that they are spread apart by a distance exceeding said predetermined dimension by about 2 to 3 millimeters, whereby the so engaged strings are subjected to a supplemental tension exceeding said certain tension, and a weight attached to said plate.

2. The device according to claim 1, wherein said plate is torus-shaped, and being formed on a periphery thereof with a groove in which corresponding ones of said strings are adapted to be nestled.

3. The device according to claim 1, wherein said plate is of a round shape.

4. The device according to claim 1, wherein said plate is torus-shaped, and being formed on a periphery thereof with a groove in which corresponding ones of said strings are adapted to be nestled, and further comprising two membranes attached to said plate near the periphery thereof, and entrapping said weight therebetween so as to maintain said weight approximately at the center of said torus-shaped plate.

5. The device according to claim 1, wherein said plate is formed with an aperture, said membranes covering said aperture.

6. The device according to claim 5, wherein said membranes are elastic, and said weight is a metal ball.

7. The device according to claim 6, wherein said weight is a drop of mercury.

8. The device according to claim 1, wherein said plate is torus-shaped, and being formed on a periphery thereof with a groove in which corresponding ones of said strings are adapted to be nestled, and further comprising a single membrane integral with said plate, and wherein said weight is formed by said plate and said membrane.

9. The device according to claim 1, further comprising another plate juxtaposed with the first-named plate, and a plurality of posts joining said plates, said posts being located so as to be adapted to exert pressure onto said strings in respective regions where a longitudinal string abuts a transverse string, said plates surrounding said strings on respective opposite sides thereof.

10. The device according to claim 1, wherein said plate is torus-shaped, and being formed on a periphery thereof with a groove in which corresponding ones of said strings are adapted to be nestled, and further comprising a membrane integral with said plate, and wherein said weight is formed by said plate and said membrane, and means to subject only selected ones of said strings to said supplemental tension, whereby vibrations of said selected ones of said strings are more strongly suppressed than vibrations of the remaining of said strings.

11. The device according to claim 10 wherein said subjecting means includes formation of a notch in said membrane so as to engage at least one of said longitudinally extending strings.

12. The device according to claim 1, wherein said weight is constituted by an assembly of weight elements which are symmetrically distributed thereon.

13. A device adapted to be used in conjunction with a racquet for tennis or for a similar sport, and wherein the racquet is strung with a plurality of elastic strings under a certain tension extending in a mesh along longitudinal and transverse directions so as define a plurality of rectangles, each rectangle having sides of a predetermined dimension, and being bounded by a pair of adjoining strings extending along said longitudinal direction, and another pair of adjoining strings extending along said transverse direction, comprising at least one plate of elastic material adapted for being emplaced in one of said rectangles so as to engage at least two of said adjoining strings, and being of such dimensions and having such an elasticity, compared to that of said strings, so as to, upon emplacement, deform the so engaged strings so that they are spread apart by a distance exceeding said predetermined dimension by about 2 to 3 millimeters, so that the so engaged strings are subjected to a supplemental tension exceeding said certain tension, a weight attached to said plate, and wherein said plate is torus-shaped, and formed on a periphery thereof with a groove in which corresponding ones of said strings are adapted to be nestled, and two membranes attached to said plate near the periphery thereof, and entrapping said weight therebetween so as to maintain said weight approximately at the center of said torus-shaped plate.

14. A device adapted to be used in conjunction with a racquet for tennis or for a similar sport, and wherein the racquet is strung with a plurality of elastic strings under a certain tension extending in a mesh along longitudinal and transverse directions so as define a plurality of rectangles, each rectangle having sides of a predetermined dimension, and being bounded by a pair of adjoining strings extending along said longitudinal direction, and another pair of adjoining strings extending along said transverse direction, comprising at least one plate of elastic material adapted for being emplaced in one of said rectangles so as to engage at least two of said adjoining strings, and being of such dimensions and having such an elasticity, compared to that of said strings, so as to, upon emplacement, deform that so engaged strings so that they are spread apart by a distance exceeding said predetermined dimension by about 2 to 3 millimeters, so that the so engaged strings are subjected to a supplemental tension exceeding said certain tension, a weight attached to said plate, and wherein said plate is torus-shaped, and is formed on a periphery thereof with a groove in which corresponding ones of said strings are adapted to be nestled, a membrane integral with said plate, and wherein said weight is formed by said plate and said membrane, means to subject only selected ones of said strings to said supplemental tension, so that vibrations of said selected ones of said strings are more strongly suppressed than vibrations of the remaining of said strings, and wherein said subjecting means includes formation of a notch in said membrane so as to engage at least one of said longitudinally extending strings.

* * * * *